US010774507B2

(12) United States Patent
Davis et al.

(10) Patent No.: US 10,774,507 B2
(45) **Date of Patent: *Sep. 15, 2020**

(54) EXCAVATOR BOOM AND EXCAVATING IMPLEMENT AUTOMATIC STATE LOGIC

(71) Applicant: Caterpillar Trimble Control Technologies LLC, Dayton, OH (US)

(72) Inventors: Kyle Davis, Dayton, OH (US); Richard Weinel, Dayton, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 163 days.

This patent is subject to a terminal disclaimer.

(21) Appl. No.: 16/169,587

(22) Filed: Oct. 24, 2018

(65) Prior Publication Data

US 2019/0093322 A1 Mar. 28, 2019

Related U.S. Application Data

(63) Continuation of application No. 15/331,387, filed on Oct. 21, 2016, now Pat. No. 10,138,618.

(51) Int. Cl.
*E02F 9/26* (2006.01)
*E02F 3/32* (2006.01)
(Continued)

(52) U.S. Cl.
CPC ..... *E02F 9/265* (2013.01); *E02F 3/32* (2013.01); *E02F 3/435* (2013.01); *E02F 3/439* (2013.01); *E02F 9/2041* (2013.01); *E02F 9/262* (2013.01)

(58) Field of Classification Search
CPC . E02F 9/265; E02F 9/2041; E02F 3/32; E02F 3/439
See application file for complete search history.

(56) References Cited

U.S. PATENT DOCUMENTS 5,933,346 A * 8/1999 Brabec ..... E02F 9/2025 340/684
6,253,160 B1 * 6/2001 Hanseder ..... E02F 3/435 342/357.27

(Continued)

OTHER PUBLICATIONS

Komatsu, Intelligent Machine Control, PC210LCi-10 Tier 4 Interim Engine, 2015, AESS872-02, AD01(2.5M)OTP, May 2015(EV-1), Komatsu America Corp., U.S.

*Primary Examiner* — Yuen Wong
(74) *Attorney, Agent, or Firm* — Dinsmore & Shohl LLP

(57) ABSTRACT

An excavator comprises a control architecture having one or more actuators and one or more controllers. The one or more controllers are programmed to execute instructions. The instructions determine if there is a request to operate the excavator boom and the excavating implement in automatics mode. The instructions also receive target design surface data representing a target design surface of an excavating operation. The instructions still further receive an implement angle representing an operating angle of the excavating implement relative to the target design surface. The instructions also determine whether the implement angle is within an activation angle, determine whether the implement angle is outside of a deactivation angle, activate the excavating implement in the automatics mode when the implement angle is within the activation angle and the deactivation angle, and deactivate when the implement angle is outside of the deactivation angle subsequent to the automatics mode activation.

19 Claims, 8 Drawing Sheets

(51) Int. Cl.
*E02F 3/43* (2006.01)
*E02F 9/20* (2006.01)

(56) References Cited

U.S. PATENT DOCUMENTS

2015/0330060 A1 11/2015 Seki et al.
2016/0054114 A1 2/2016 Crozier et al.

* cited by examiner

EXCAVATOR BOOM AND EXCAVATING IMPLEMENT AUTOMATIC STATE LOGIC

CROSS-REFERENCE TO RELATED APPLICATIONS

This application is a continuation of U.S. Non-Provisional application Ser. No. 15/331,387, filed Oct. 21, 2016, which claims the benefit of U.S. Provisional Application Ser. No. 62/402,094, filed Sep. 30, 2016.

BACKGROUND

The present disclosure relates to automatic controls in the use of excavators.

The operation of earthmoving excavators requires skill and experience from the operator in order to properly perform functions such as raking and excavation. Operators can benefit from machine-assisted automatics. Without surrendering control of the excavator, an operator may be assisted with the precision required in many excavator functions.

BRIEF SUMMARY

According to the subject matter of the present disclosure, excavator control architecture is provided to operate the excavating implement in automatics mode based on implement angle. In this manner, an excavator can move between various modes of automatics, in a manner that is seamless to the operator. Rather than adding extra complexity for the operator, the automatics can provide intuitive tools that enhance the operator's use of the excavator and increase efficiency.

In accordance with one embodiment of the present disclosure, an excavator comprises a an excavator boom, an excavator stick configured to curl relative to the excavator boom, an excavating implement mechanically coupled to a terminal point of the excavator stick, and control architecture. The control architecture comprises one or more actuators and one or more controllers. The one or more controllers are configured to execute instructions. The instructions determine there is a request to operate the excavating implement in automatics mode. The instructions also receive target design surface data representing a target design surface of an excavating operation. The instructions still further receive an implement angle θ representing an operating angle of the excavating implement relative to the target design surface. The instructions also determine whether the implement angle θ is within an activation angle α, wherein the activation angle α represents an angle within which operation of the excavating implement in automatics mode is permissible. The instructions further determine whether the implement angle θ is outside of a deactivation angle β, wherein the deactivation angle β is outside of the activation angle α, and represents an angle outside of which operation of the excavating implement in automatics mode is not permissible subsequent to the automatics mode activation in response to the implement angle θ being within the activation angle α. The instructions also operate the excavator boom in automatics mode based on the determination of whether the implement position P is within the automatics region of the target design surface. The instructions also activate the excavating implement in the automatics mode based on the determination (i) the implement angle θ is within the activation angle α, and (ii) the implement angle θ is within the deactivation angle β, and deactivate operation of the excavating implement from the automatics mode based on the determination (i) the implement angle θ is outside of the deactivation angle β and (ii) subsequent to the automatics mode activation.

In accordance with another embodiment of the present disclosure, an excavator comprises a control architecture having one or more linkage assembly actuators and one or more controllers. The one or more controllers are configured to execute instructions. The instructions determine there is a request to operate the excavating implement in automatics mode. The instructions also receive target design surface data representing a target design surface of an excavating operation. The instructions still further receive an implement angle θ representing an operating angle of the excavating implement relative to the target design surface. The instructions also determine whether the implement angle θ is within an activation angle α, wherein the activation angle α represents an angle within which operation of the excavating implement in automatics mode is permissible. The instructions further determine whether the implement angle θ is outside of a deactivation angle β, wherein the deactivation angle β is outside of the activation angle α, and represents an angle outside of which operation of the excavating implement in automatics mode is not permissible subsequent to automatics mode activation based on the implement angle θ being within the activation angle α. The instructions also activate the excavating implement in the automatics mode based on the determination (i) the implement angle θ is within the activation angle α, and (ii) the implement angle θ is within the deactivation angle β, and deactivate operation of the excavating implement from the automatics mode based on the determination (i) the implement angle θ is outside of the deactivation angle β and (ii) subsequent to the automatics mode activation.

Although the concepts of the present disclosure are described herein with primary reference to a particular type of excavator, i.e., the excavator illustrated in FIGS. 1-3 and 5-7, it is contemplated that the concepts will enjoy applicability to any form of excavating machinery, particularly those employing an excavating linkage assembly and an excavating implement. It is further contemplated that an "excavator," as described herein may be employed in digging, grading, mining, paving, or any type of earth or materials moving operation.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
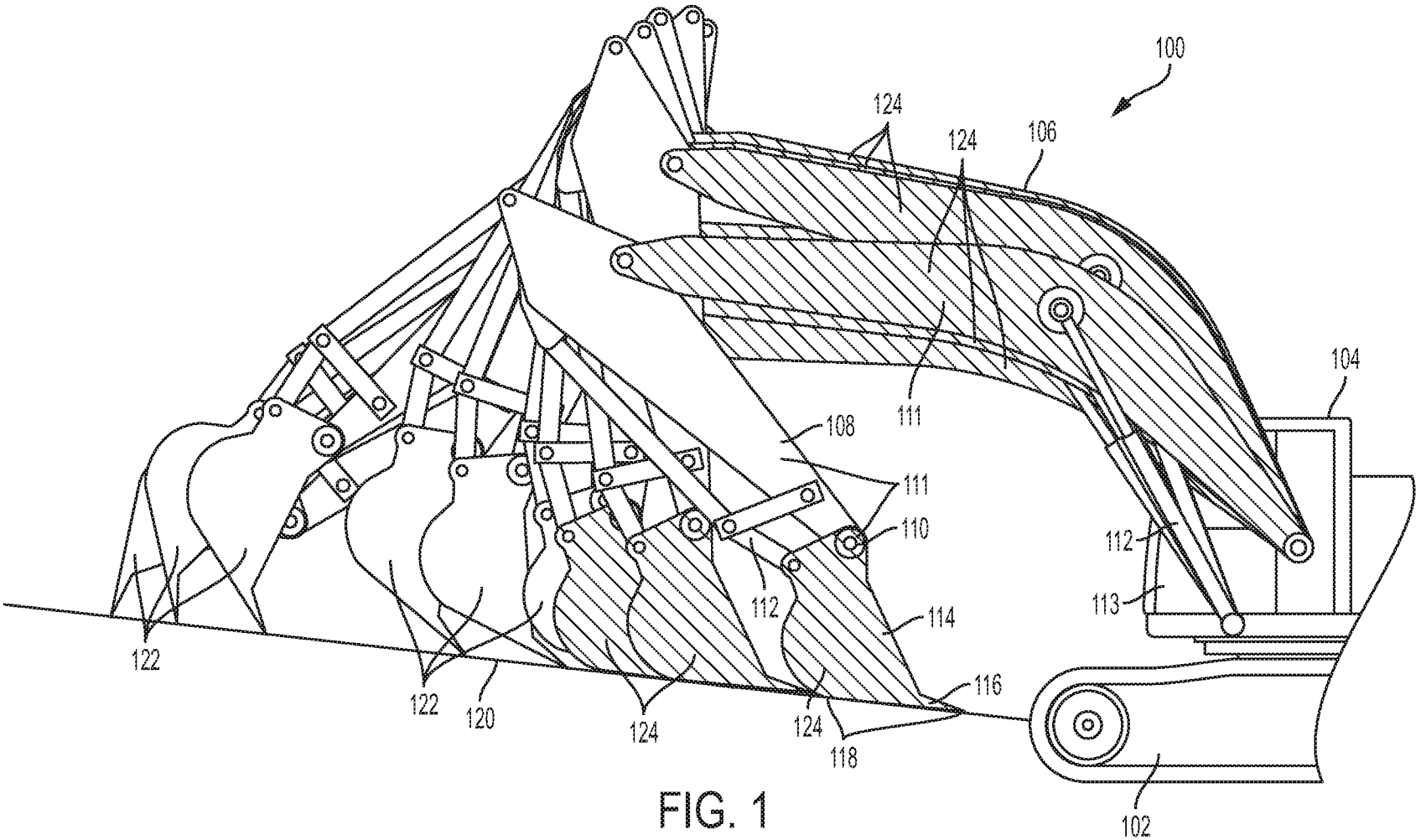
FIG. 1 depicts an excavator operating with boom and bucket automatics according to one or more embodiments shown and described herein.

Referring initially to FIG. 1, a depiction of an excavator 100 in various stages of automatics is shown. The excavator 100 comprises a machine chassis 102, an excavating linkage assembly 111, an excavating implement 114, and control architecture comprising one or more linkage assembly actuators 112 and one or more controllers 113 for executing particular instructions described herein. The excavating linkage assembly 111 comprises an excavator boom 106, an excavator stick 108, and an implement coupling 110 and is configured to swing with, or relative to, the machine chassis 102. The excavator stick 108 is configured to curl relative to the excavator boom 106 and the excavating implement 114 is mechanically coupled to a terminal point of the excavator stick 108 via the implement coupling 110. The excavator 100 may also feature a cab 104.

The cab 104 resides on top of the chassis 102 in this embodiment, although different configurations may be utilized in other embodiments. The boom 106 may be coupled to the cab 104 at one end, coupled to the stick 108 at the other end of the boom 106, and have hydraulics connected to the boom 106 in between the ends. Other embodiments may use different suitable configurations. The stick 108 may feature an implement coupling 110 to which an implement 114 is attached. While the implement 114 is depicted as a bucket in this embodiment, any suitable type of attachment may be utilized, such as loaders, cutters, saws, drills, blades, pushers, breakers, boring units, mixers, chippers, pumps, hammers, graders, grapples, mowers, landplanes, planers, brooms, pallet forks, scarifiers, packer wheels, spreaders, layers, sweepers, grinders, trenchers, plows or any other suitable type of implement. Any suitable type of implement coupling 110 may be utilized, such as rotational, clamps, pin-ons, or any other suitable type of coupling. Additionally, one or more linkage assembly actuators 112 may be utilized between the stick 108 and the implement 114. The implement 114 may feature implement teeth 116 as well as an implement portion 118 for determining an angle of the implement 114. While the implement portion 118 in this embodiment is depicted as a flat, exterior surface, any suitable portion of the implement may be utilized.

The excavator 100 may utilize the implement 114 to interact with a design surface 120, which as depicted here corresponds to the current ground level/slope. In some embodiments, the target design surface 120 may differ from the current ground level/slope. It is contemplated that target design surface data representing the target design surface 120 may be received in a variety of ways. For example, target design surface data may be received as a user input from an excavator operator, programmer, etc., or may be received as a hardwired or otherwise preconfigured parameter or set of parameters. The boom 106 and/or the implement 114 can be placed into, and be removed from, a state of automatics. With respect to the automatics of the boom 106 and/or implement 114, manual control 122 is represented in the figures by a lack of hatching. Components operating in automatics 124 are represented by hatching. In this embodiment, boom 106 and/or implement automatics 124 provide machine assistance, guidance, and/or control over operation. Automatics may move and/or rotate components based upon the movement of another component. For example, moving the implement 114 with manual control 122, such as by an operator of the excavator 100, may result in corresponding movement of the boom 106 in automatics 124. In other instances, components in automatics 124 may move without input from the operator of the excavator 100. The embodiment shown in FIG. 1 depicts a time-lapse view (progressing from left to right) of the implement 114 under manual control 122 for the six frames on the left, and in automatics 124 on the three frames on the right. The operator uses manual control 122 of the implement 114 in the earlier frames on the left (with assistance of boom automatics 124) to keep the implement 114 in conformance with the target design surface 120. By contrast, no operator input is required to keep the implement 114 conforming to the target design surface 120 when the implement 114 is in automatics 124. As discussed below in more detail, automatics may be utilized for a variety of actions, such as excavation depicted in FIG. 5, power raking depicted in FIG. 6, and compaction depicted in FIG. 7.

Figure 2:
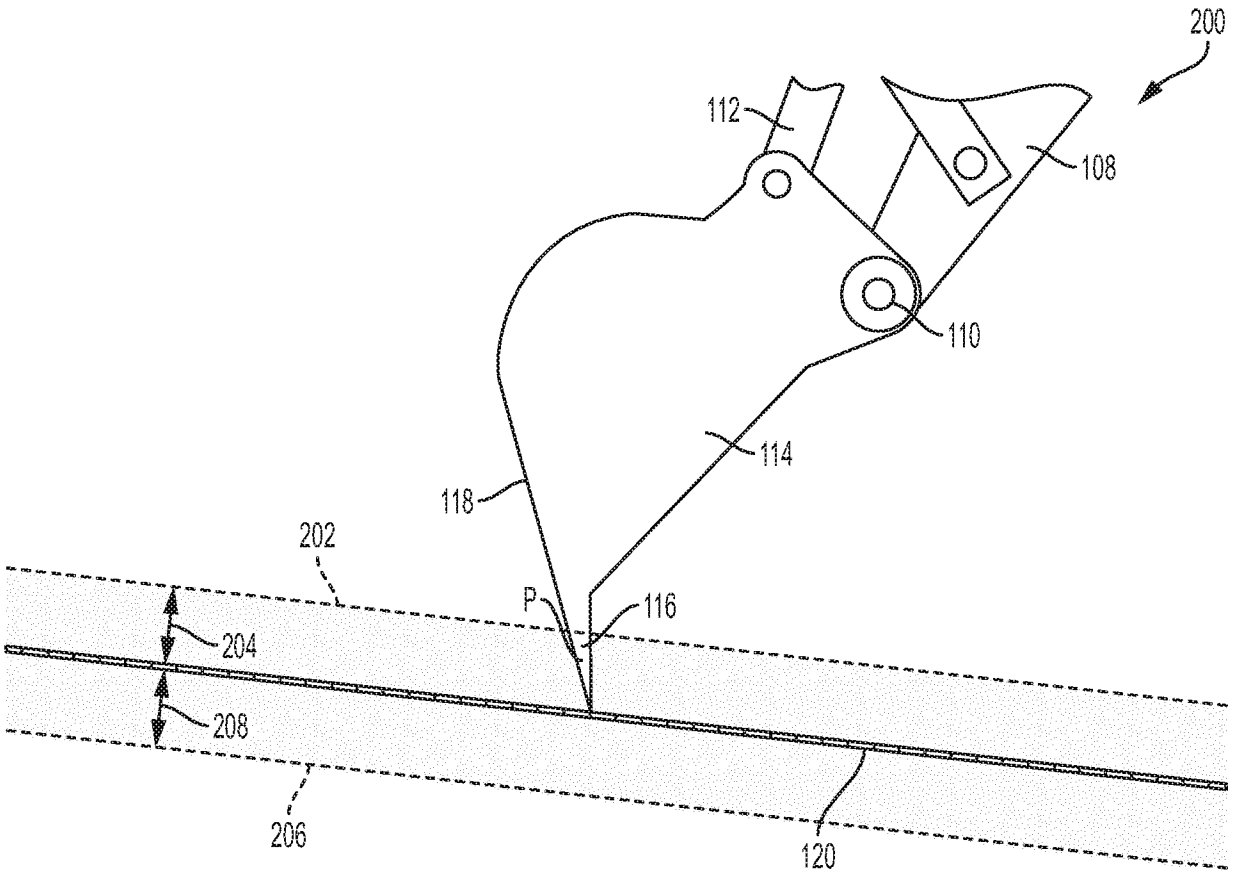
FIG. 2 depicts an excavator bucket within a threshold distance of a design surface according to one or more embodiments shown and described herein.

Turning to FIG. 2, an embodiment depicting a criterion of boom automatics operation 200 is shown. An upper threshold 202 of an upper automatics region 204 resides above the target design surface 120. A lower threshold 206 of a lower automatics region 208 resides below the target design surface 120. In the embodiment depicted, implement position P is based on the location of the implement teeth 116. For example, boom automatics 124 may activate if the implement teeth 116 enter or reside in the area between the upper threshold 202 and the lower threshold 206. In other embodiments, any suitable portion of the implement 114 may be utilized instead of the implement teeth 116. In some embodiments, only an upper threshold 202 or a lower threshold 206 may be utilized. In the embodiment depicted, the upper automatics region 204 and the lower automatics region 208 have the same height with respect to the target design surface 120. In other embodiments, upper automatics region 204 and lower automatics region 208 may have different heights with respect to the target design surface 120. In other embodiments, different types of automatics may be triggered with respect to upper automatics region 204 and/or lower automatics region 208.

In some embodiments, in order to enter boom automatics 124, prerequisite conditions may have to first be met. For example, in this embodiment the excavator 100 must first be primed for automatics, which may be accomplished by arming a valve module (not shown). Continuing with the current example, once the excavator 100 is primed for automatics, a request for automatics from the excavator operator needs to be received. In this example, once the request for automatics has been received, and the implement teeth 116 are within the upper automatics region 204 or the lower automatics region 208, boom automatics 124 can be activated. Other embodiments may utilize different prerequisite requirements, and still other embodiments may not utilize any prerequisite requirements. In this embodiment, boom automatics 124 deactivate automatically when the implement teeth 116 no longer reside within either the upper automatics region 204 or the lower automatics region 208. In some embodiments, the upper automatics region 204 and/or the lower automatics region 208 may be received as either an excavator operator input or a programmer input. In other embodiments the upper automatics region 204 and/or the lower automatics region 208 may be received as a user input from an excavator operator, programmer, etc., or may be received as a hardwired or otherwise preconfigured parameter or set of parameters. Some embodiments have only an upper automatics region 204 or a lower automatics region 208. In some embodiments, the upper automatics region 204 and the lower automatics region 208 form a single automatics region.

Figure 3:
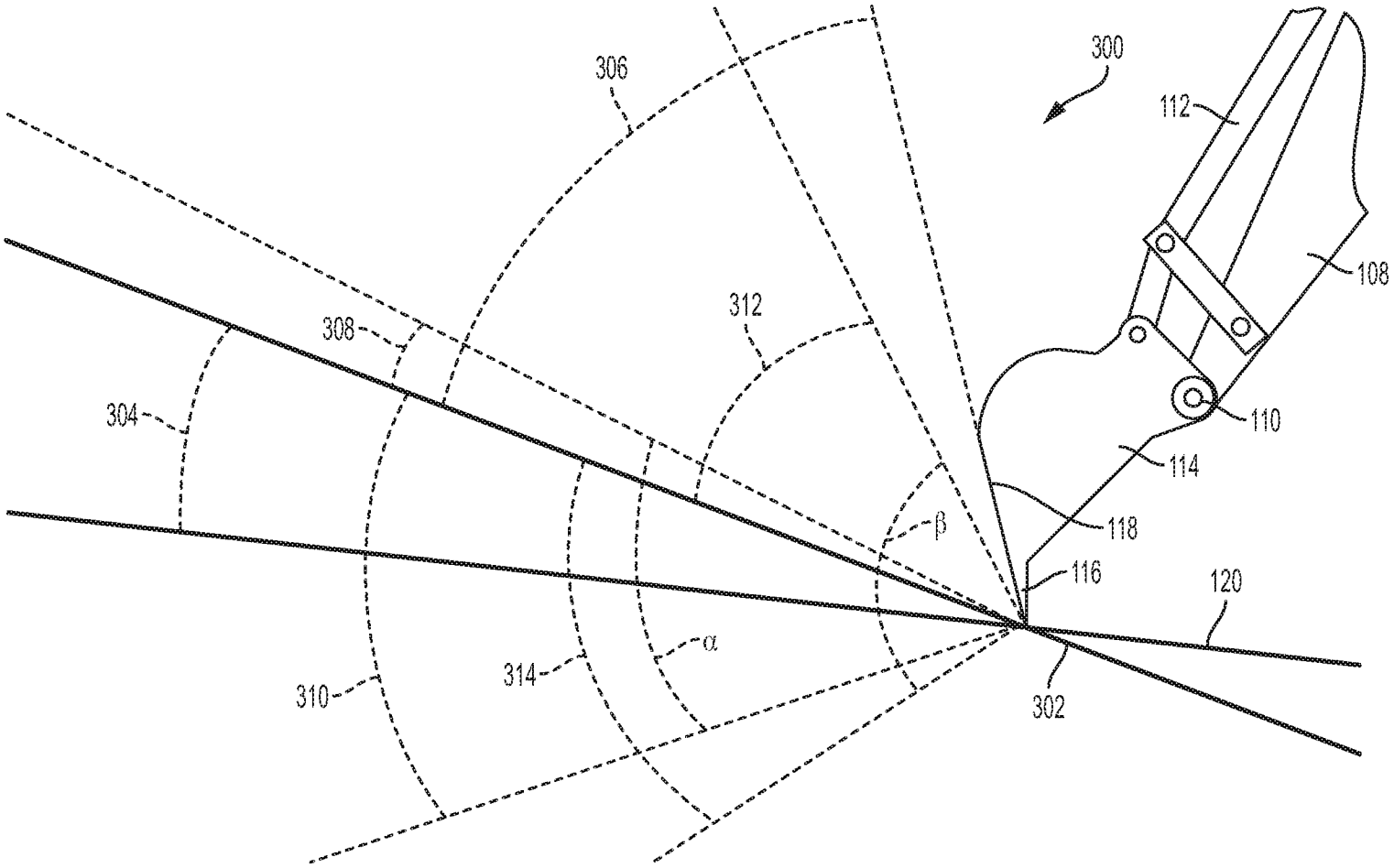
FIG. 3 depicts an excavator bucket with respect to various operating angles according to one or more embodiments shown and described herein.

Turning to FIG. 3, an embodiment depicting a criterion of implement automatics operation 300 is shown. In this embodiment, boom automatics 124 must first be engaged before implement automatics can be implemented. Other embodiments may have different prerequisite conditions, while still other embodiments may impose no prerequisite conditions at all. In FIG. 3, the implement 114 is in contact with the target design surface 120. In this embodiment, the angle of the implement 114 measured with respect to the plane of the implement portion 118, which is depicted as a flat exterior portion. In other embodiments, the implement portion 118 may be any suitable part of the implement 114.

A target implement slope 302 is provided, which in some embodiments is the angle of the implement portion 118 once the implement 114 is in automatics 124. The angular distance from the target design surface 120 to the target implement slope 302 is the angle of attack 304 in this embodiment. Once the target implement slope 302 is known, the implement angle θ 306 can be determined as the angular distance between the target implement slope 302 and the angle of the implement portion 118. An activation angle α is shown in this embodiment, and comprises equal or unequal sub-angles in the form of an upper activation angle 308 and a lower activation angle 310, with each being measured from the target implement slope 302 such that the activation angle α encompasses the target design surface 120. In this embodiment, implement automatics are activated when the implement portion 118 is within the activation angle α or, more specifically, when the implement portion 118 enters either the upper activation angle 308 or the lower activation angle 310.

A separate deactivation angle β is shown in this embodiment, and comprises equal or unequal sub-angles in the form of an upper deactivation angle 312 and a lower deactivation angle 314, with each being measured from the target implement slope 302, such that the deactivation angle β encompasses the target design surface 120. In this embodiment, the upper deactivation angle 312 exceeds the upper activation angle 308 and the lower deactivation angle 314 exceeds the lower activation angle 310. Any suitable angle sizes may be used for the various angles depicted in FIG. 3. In this embodiment, implement automatics are deactivated when the implement portion 118 is outside of, or exits, the deactivation angle β or, more specifically, the upper deactivation angle 312 and/or the lower deactivation angle 314.

In some embodiments, the target implement slope 302, the angle of attack 304, the implement angle θ 306, the upper activation angle 308, the lower activation angle 310, the upper deactivation angle 312, and/or the lower deactivation angle 314 may be received as a user input, e.g., either an excavator operator input or a programmer input. In other embodiments the target implement slope 302, the angle of attack 304, the implement angle θ 306, the upper activation angle 308, the lower activation angle 310, the upper deactivation angle 312, and/or the lower deactivation angle 314 may be received as a hardwired or otherwise preconfigured parameter or set of parameters.

Figure 4:
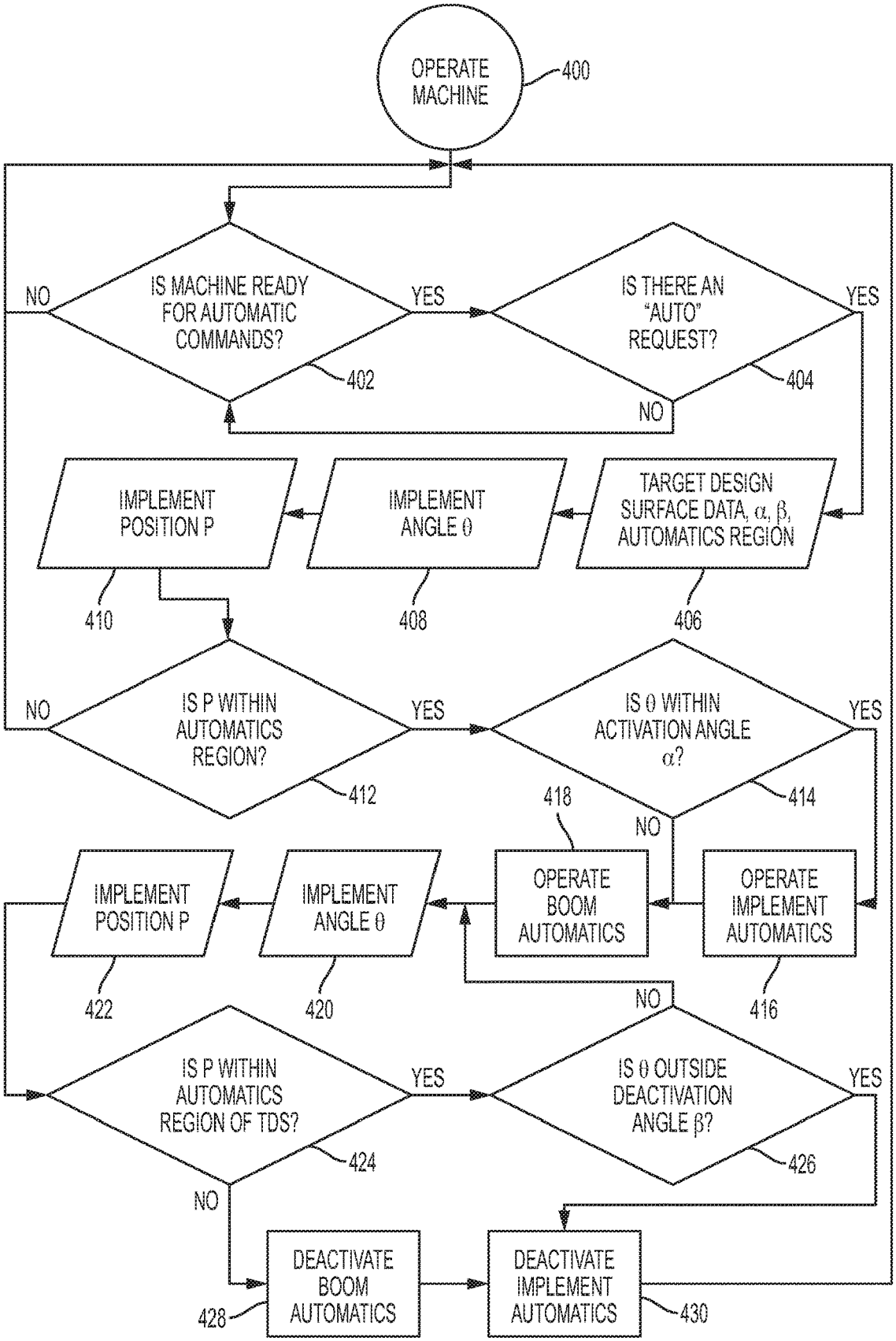
FIG. 4 depicts a flowchart of an algorithm for operating an excavator boom and/or bucket in automatics according to one or more embodiments shown and described herein.

Turning to FIG. 4, a flowchart depicts activation and deactivation of automatics. At 400, an excavator is being controlled by an operator. At 402 a determination is made as to whether the excavator is ready for automatics commands. If the excavator is not ready for automatics commands, then the excavator continues under normal operation at 400. If the excavator is ready for automatics commands, then at 404 a determination is made as to whether there is an automatics request. If there is not an automatics request, the excavator continues being ready for automatic commands at 402. If there is an automatics request, the excavator continues to 406, where data for the target design surface, the activation angle, and the deactivation angle β is received. In other embodiments, these data may already be received or be preconfigured. In the embodiment depicted in FIG. 4, activation angle α is the combination of the upper activation angle 308 and the lower activation angle 310 and deactivation angle β is the combination of upper deactivation angle 312 and the lower deactivation angle 314. In some embodiments, the automatics region is received. In other embodiments, the automatics region is preconfigured.

At 408 an implement angle θ representing an operating angle of the excavating implement relative to the target design surface is received. At 410 an implement position P representing a position of the excavating implement relative to the target design surface is received. At 412 a determination is made as to whether the implement position P is within the automatics region of the target design surface, wherein the automatics region represents a region on one or both sides of the target design surface within which operation of the excavator boom in automatics mode is permissible. If the implement position P is not within the automatics region, the excavator returns to normal operation at 400.

If the implement position P is within the automatics region, then at 414 a determination is made as to whether the implement angle θ is within the activation angle α, wherein the activation angle α represents an angle within which operation of the excavating implement in automatics mode is permissible. If the implement angle θ is not within the activation angle α, then boom automatics are operated at 418. If the implement angle θ is within the activation angle α, then implement automatics are operated at 416 and at 418 boom automatics are operated.

At 420 an updated implement angle θ is received. At 422 an updated implement position P is received. At 424 a determination is made as to whether implement position P is within the automatics region. If implement position P is not within the automatics region, then the boom automatics are deactivated at 428 and the implement automatics are deactivated at 430 so that the excavator returns to normal operations at 400. If the implement position P is within the automatics region, then at 426 a determination is made as to whether the updated implement angle θ is outside of the deactivation angle β, wherein the deactivation angle β is outside of the activation angle α, and represents an angle outside of which operation of the excavating implement in automatics mode is not permissible. If the updated implement angle θ is not outside of the deactivation angle β, then the updated implement angle θ is received at 420. If the updated implement angle θ is outside of the deactivation angle β, then at 430 the implement automatics are deactivated and the excavator returns to normal operations at 400.

Figure 5:
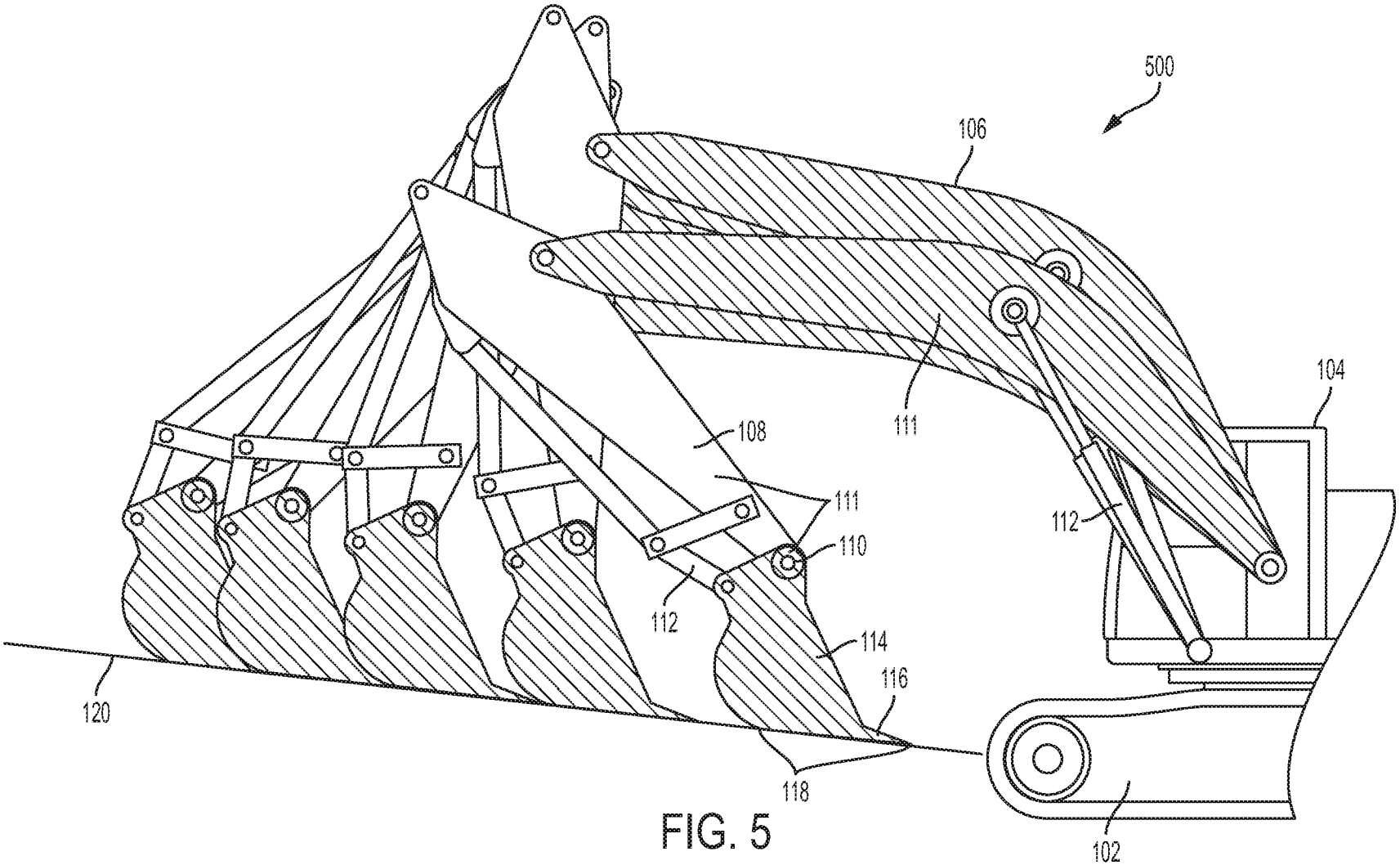
FIG. 5 depicts an excavator operating with boom automatics and bucket automatics for excavation according to one or more embodiments shown and described herein.

Turning to FIG. 5, 500 is a side view depiction of excavation utilizing automatics for the boom 106 and the implement 114 as the implement 114 moves from left to right. The implement portion 118 maintains constant contact with, and remains parallel to, the target design surface 120.

Figure 6:
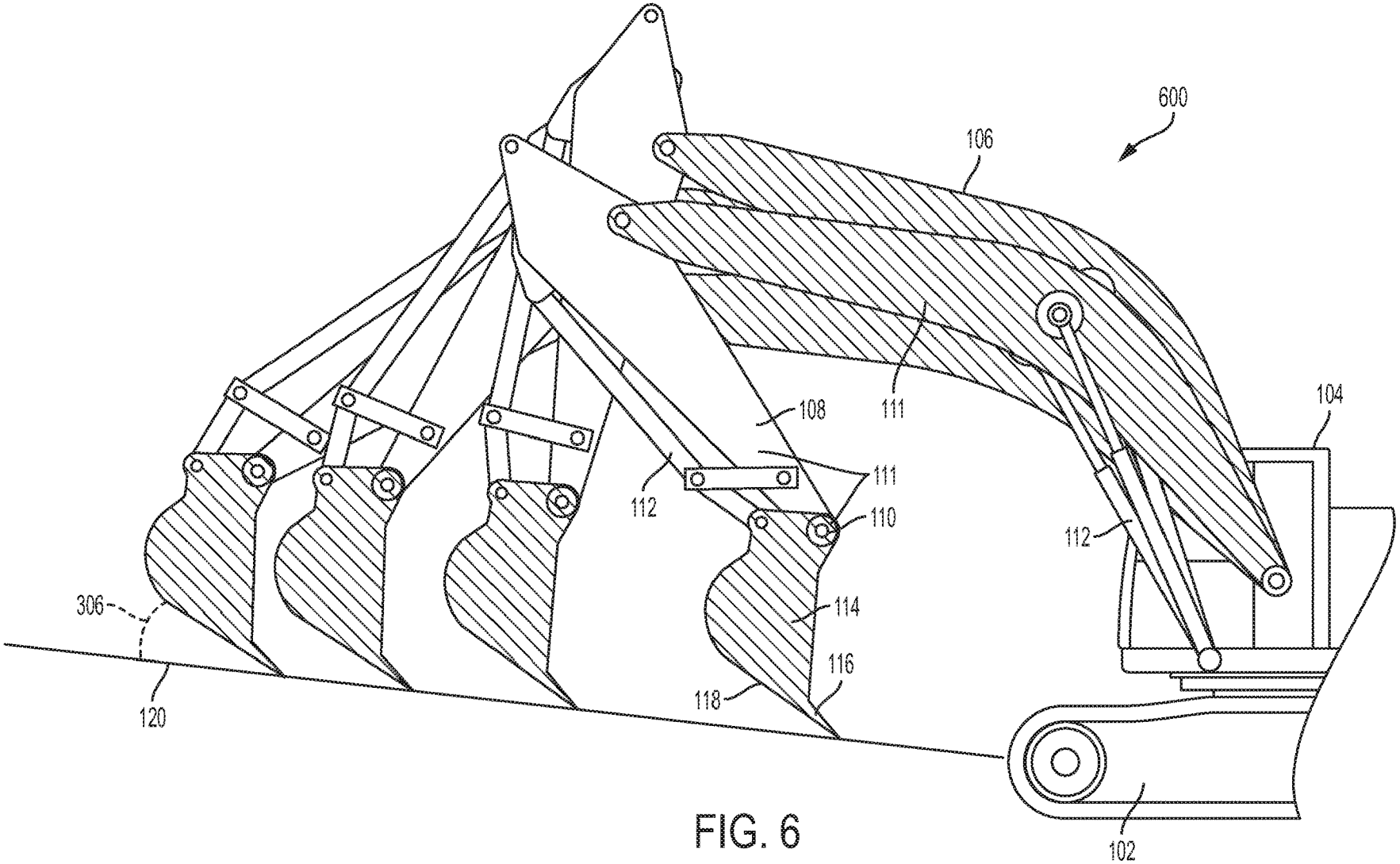
FIG. 6 depicts an excavator operating with boom automatics and bucket automatics for power raking according to one or more embodiments shown and described herein.

Turning to FIG. 6, 600 is a side view depiction of power raking utilizing automatics for the boom 106 and the implement 114 as the implement 114 moves from left to right. The implement teeth 116 maintain constant contact with the target design surface 120. Additionally, the implement angle θ 306 remains constant.

Figure 7:
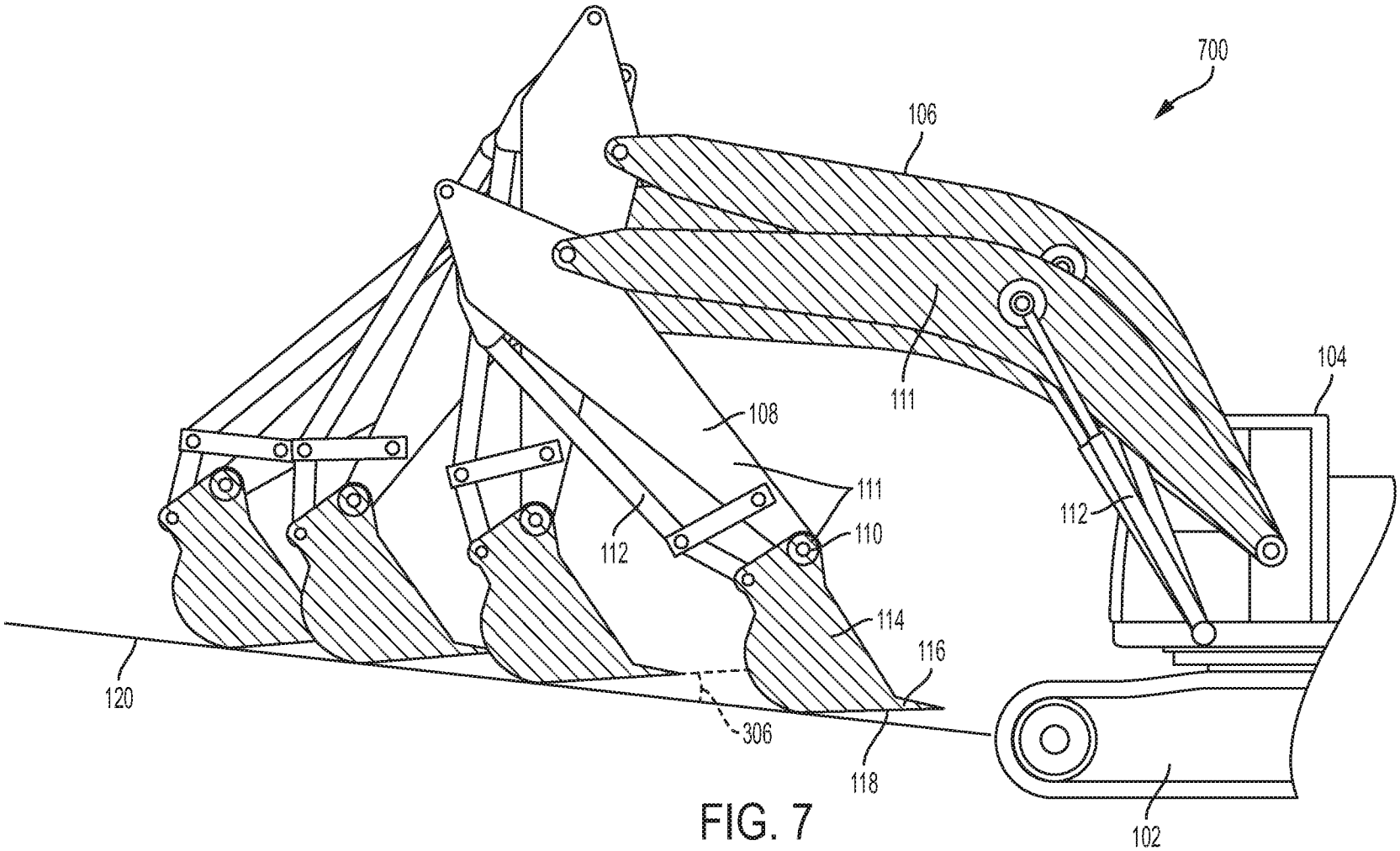
FIG. 7 depicts an excavator operating with boom automatics and bucket automatics for compaction according to one or more embodiments shown and described herein.

Turning to FIG. 7, 700 is a side view depiction of compaction utilizing automatics for the boom 106 and the implement 114 as the implement 114 moves from left to right. Additionally, the implement angle θ 306 remains constant.

Figure 8:
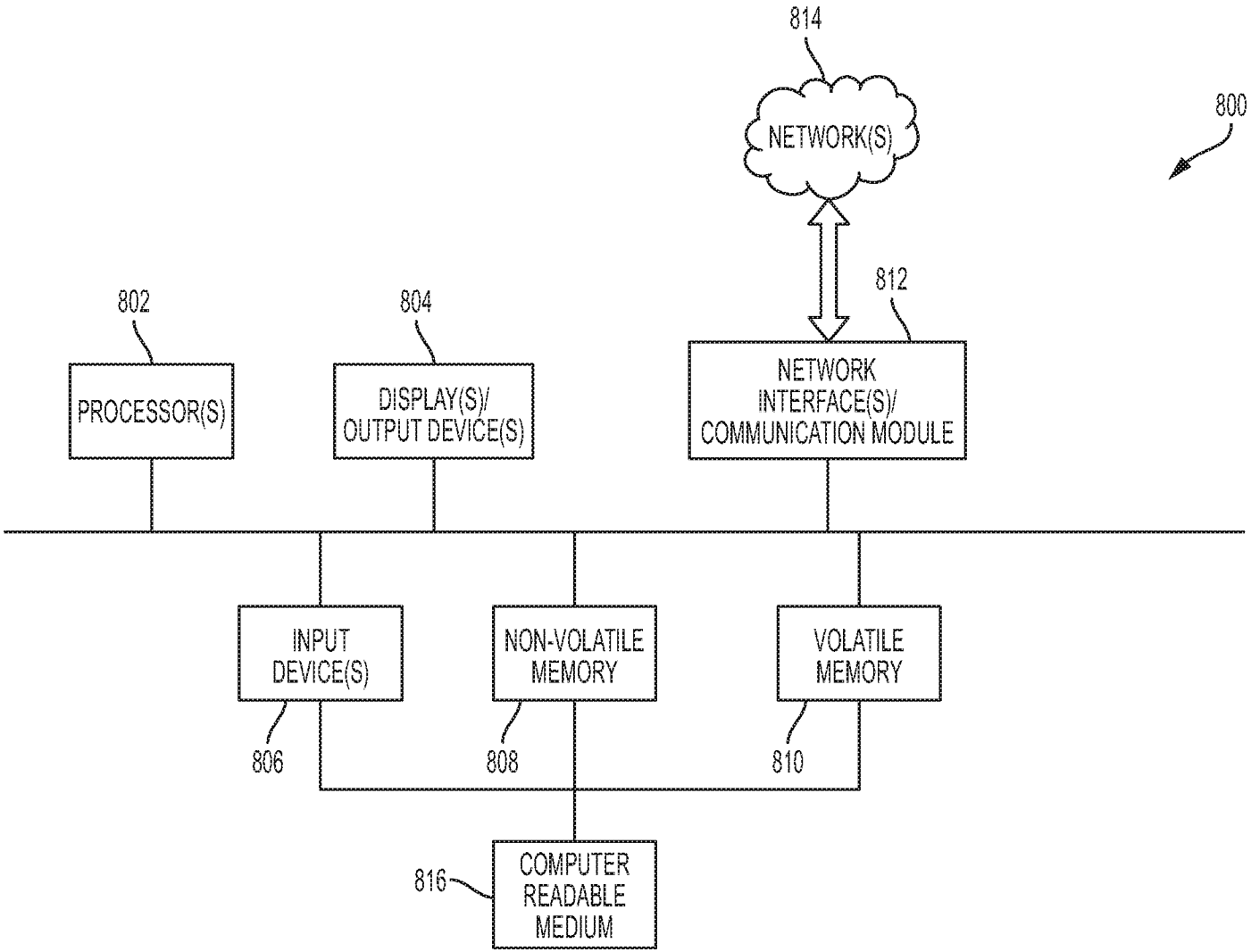
FIG. 8 depicts a computing device embodied in a controller according to one or more embodiments shown and described herein.

Turning to FIG. 8, a block diagram illustrates an example of a computing device 800, through which embodiments of the disclosure can be implemented, for example in an excavator controller 113. The computing device 800 described herein is but one example of a suitable computing device and does not suggest any limitation on the scope of any embodiments presented. Nothing illustrated or described with respect to the computing device 800 should be interpreted as being required or as creating any type of dependency with respect to any element or plurality of elements. In various embodiments, a computing device 800 may include, but need not be limited to, a desktop, laptop, server, client, tablet, smartphone, or any other type of device that can compress data. In an embodiment, the computing device 800 includes at least one processor 802 and memory (non-volatile memory 808 and/or volatile memory 810). The computing device 800 can include one or more displays and/or output devices 804 such as monitors, speakers, headphones, projectors, wearable-displays, holographic displays, and/or printers, for example. The computing device 800 may further include one or more input devices 806 which can include, by way of example, any type of mouse, keyboard, disk/media drive, memory stick/thumb-drive, memory card, pen, touch-input device, biometric scanner, voice/auditory input device, motion-detector, camera, scale, etc.

The computing device 800 typically includes non-volatile memory 808 (ROM, flash memory, etc.), volatile memory 810 (RAM, etc.), or a combination thereof. A network interface 812 can facilitate communications over a network 814 via wires, via a wide area network, via a local area network, via a personal area network, via a cellular network, via a satellite network, etc. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, and/or other near field communication protocols. Suitable personal area networks may similarly include wired computer buses such as, for example, USB and FireWire. Suitable cellular networks include, but are not limited to, technologies such as LTE, WiMAX, UMTS, CDMA, and GSM. Network interface 812 can be communicatively coupled to any device capable of transmitting and/or receiving data via the network 814. Accordingly, the hardware of the network interface 812 can include a communication transceiver for sending and/or receiving any wired or wireless communication. For example, the network interface hardware may include an antenna, a modem, LAN port, Wi-Fi card, WiMax card, mobile communications hardware, near-field communication hardware, satellite communication hardware and/or any wired or wireless hardware for communicating with other networks and/or devices.

A computer readable storage medium 816 may comprise a plurality of computer readable mediums, each of which may be either a computer readable storage medium or a computer readable signal medium. A computer readable storage medium 816 may reside, for example, within an input device 806, non-volatile memory 808, volatile memory 810, or any combination thereof. A computer readable storage medium can include tangible media that is able to store instructions associated with, or used by, a device or system. A computer readable storage medium includes, by way of non-limiting examples: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave. Computer readable storage media and computer readable signal media are mutually exclusive.

The computing device 800 may include one or more network interfaces 812 to facilitate communication with one or more remote devices 818, which may include, for example, client and/or server devices. A network interface 812 may also be described as a communications module, as these terms may be used interchangeably.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. An excavator comprising:

an excavator boom;

an excavator stick configured to curl relative to the excavator boom;

an excavating implement mechanically coupled to a terminal point of the excavator stick; and control architecture, wherein the control architecture comprises one or more actuators and one or more controllers, and the one or more controllers are configured to execute instructions to receive a request to operate the excavating implement in automatics mode, receive target design surface data representing a target design surface of an excavating operation, receive an implement angle θ representing an operating angle of the excavating implement relative to the target design surface, determine whether the implement angle θ is within an activation angle α, wherein the activation angle α represents an angle within which operation of the excavating implement in the automatics mode is permissible, determine whether the implement angle θ is outside of a deactivation angle β, wherein the deactivation angle β is outside of the activation angle π, and represents an angle outside of which operation of the excavating implement in the automatics mode is not permissible subsequent to the automatics mode activation in response to the implement angle θ being within the activation angle α, activate the excavating implement in the automatics mode based on the determination (i) the implement angle θ is within the activation angle α, and (ii) the implement angle θ is within the deactivation angle β, and deactivate operation of the excavating implement from the automatics mode based on the determination (i) the implement angle θ is outside of the deactivation angle β and (ii) subsequent to the automatics mode activation.

2. The excavator of claim 1, further comprising a machine chassis, the boom configured to swing with, or relative to, the machine chassis, wherein the one or more controllers is configured to execute instructions to:

receive an implement position P representing a position of the excavating implement relative to the target design surface;

determine whether the implement position P is within an automatics region of the target design surface, wherein the automatics region represents a region on one or both sides of the target design surface within which operation of the excavator boom in the automatics mode is permissible; and operate the excavator boom in the automatics mode based on the determination the implement position P is within the automatics region of the target design surface.

3. The excavator of claim 2, wherein the one or more controllers is configured to execute instructions to deactivate both boom automatics and implement automatics when the implement position P moves outside of the automatics region of the target design surface.

4. The excavator of claim 2 wherein the automatics region comprises an upper automatics region above the target design surface and a lower automatics region below the target design surface.

5. The excavator of claim 4 wherein the upper automatics region has a height that differs from that of the lower automatics region.

6. The excavator of claim 2 wherein the automatics region is measured between the target design surface and teeth on the excavating implement.

7. The excavator of claim 1, wherein the deactivation angle β encompasses the target design surface.

8. The excavator of claim 1, wherein the one or more controllers is configured to execute instructions to determine whether the excavator is primed for operation in the automatics mode.

9. The excavator of claim 1 wherein the one or more controllers receives the target design surface, the activation angle α, or the deactivation angle β as a hardwired preconfigured parameter or set of parameters.

10. The excavator of claim 1 wherein the one or more controllers receives the target design surface, the activation angle α, or the deactivation angle β as a user input.

11. The excavator of claim 1 wherein a parameter or a set of parameters for a target implement slope and an angle of attack are received by the one or more controllers.

12. The excavator of claim 11 wherein the activation angle α further comprises unequal sub-angles on opposite sides of the target implement slope.

13. The excavator of claim 12 wherein the unequal sub-angles are received as separate values.

14. The excavator of claim 1 wherein the activation angle α encompasses the target design surface.

15. The excavator of claim 1 wherein the deactivation angle β encompasses the target design surface.

16. The excavator of claim 15 wherein the deactivation angle β further comprises unequal sub-angles on opposite sides of the target implement slope.

17. The excavator of claim 15 wherein the unequal sub-angles are received as separate values.

18. The excavator of claim 1 wherein the one or more controllers is configured to execute instructions for the excavating implement, upon the activation of the excavating implement in the automatics mode, to automatically maintain constant contact with the target design surface.

19. An excavator comprising:

control architecture, wherein the control architecture comprises one or more linkage assembly actuators and one or more controllers, wherein the one or more controllers are configured to execute instructions to receive a request to operate an excavating implement in automatics mode;

receive target design surface data representing a target design surface of an excavating operation;

receive an implement angle θ representing an operating angle of the excavating implement relative to the target design surface;

determine whether the implement angle θ is within an activation angle α, wherein the activation angle α represents an angle within which operation of the excavating implement in the automatics mode is permissible;

determine whether the implement angle $\theta$ is outside of a deactivation angle $\beta$, wherein the deactivation angle $\beta$ is outside of the activation angle $\alpha$, and represents an angle outside of which operation of the excavating implement in the automatics mode is not permissible subsequent to automatics mode activation based on the implement angle $\theta$ being within the activation angle $\alpha$;

activate the excavating implement in the automatics mode based on the determination (i) the implement angle $\theta$ is within the activation angle $\alpha$, and (ii) the implement angle $\theta$ is within the deactivation angle $\beta$; and deactivate operation of the excavating implement from the automatics mode based on the determination (i) the implement angle $\theta$ is outside of the deactivation angle $\beta$ and (ii) subsequent to the automatics mode activation.

* * * * *